US009090373B2

(12) United States Patent
Hainaut et al.

(10) Patent No.: US 9,090,373 B2
(45) Date of Patent: Jul. 28, 2015

(54) ERGONOMIC DISPENSING CONTAINER

(75) Inventors: Laurent Hainaut, New York, NY (US); Simon Dutton, New York, NY (US)

(73) Assignee: RECKITT BENCKISER (BRANDS) LIMITED, Slough, Berkshire (GB)

( * ) Notice: Subject to any disclaimer, the term of this patent is extended or adjusted under 35 U.S.C. 154(b) by 1066 days.

(21) Appl. No.: 12/002,151

(22) Filed: Dec. 14, 2007

(65) Prior Publication Data

US 2008/0173653 A1 Jul. 24, 2008

Related U.S. Application Data

(63) Continuation-in-part of application No. 29/275,159, filed on Dec. 15, 2006, now Pat. No. Des. 588,924.

(51) Int. Cl.

| | |
|---|---|
| ***B65D 90/02*** | (2006.01) |
| ***B65D 1/44*** | (2006.01) |
| ***B65D 8/12*** | (2006.01) |
| ***B65D 1/02*** | (2006.01) |
| ***B65D 79/00*** | (2006.01) |
| ***B65D 23/10*** | (2006.01) |
| ***B65D 47/26*** | (2006.01) |
| ***B65D 47/40*** | (2006.01) |

(52) U.S. Cl.

CPC ..... *B65D 1/0223* (2013.01); *B65D 23/102* (2013.01); *B65D 47/261* (2013.01); *B65D 47/40* (2013.01); *B65D 79/005* (2013.01); *B65D 2501/0081* (2013.01)

(58) Field of Classification Search

CPC ..... B65D 1/0223; B65D 2501/0081; B65D 79/005; B65D 23/102; B65D 2501/0027; B65D 2501/0036; B65D 2501/0018

USPC ..... 215/384; 220/669, 755, 771, 914; D9/522, 523, 529, 530, 538–543, 552, D9/565

See application file for complete search history.

(56) References Cited

U.S. PATENT DOCUMENTS

| | | | | | |
|---|---|---|---|---|---|
| 114,775 | A | * | 5/1871 | Davison | 169/81 |
| D64,127 | S | * | 3/1924 | Miller | D9/538 |
| D69,772 | S | * | 3/1926 | Ritz | D9/538 |
| D105,797 | S | * | 8/1937 | Kiln | D9/522 |
| D171,647 | S | * | 3/1954 | Hills | D9/523 |
| D183,809 | S | * | 10/1958 | Roberts | D9/539 |
| D187,820 | S | * | 5/1960 | Vuillemenot | D9/552 |

(Continued)

*Primary Examiner* — Anthony Stashick
*Assistant Examiner* — Ned A Walker
(74) *Attorney, Agent, or Firm* — Troutman Sanders, LLP; Ryan A. Schneider; Elizabeth-Ann Weeks

(57) ABSTRACT

A container having sides with contours that readily and essentially automatically orient the container upon grasping the container. The container may have distinct, discontinuous contours on opposite sides, defining grasping sides of the container. If a dispensing portion is offset from the container's central axis, then upon grasping the container at the distinct contoured grasping sides, the dispensing orifice is automatically positioned at a predetermined orientation with respect to the user's grasping hand. Such contours thus provide a tactile indicator of the orientation of the container, permitting orienting of the container in a user's hand without the need for visual assessment or inspection of the container. The container closure may further be shaped and configured to provide another tactile indicator of the container orientation. For instance, the closure may be asymmetrical. Preferably, such asymmetry is about the axis extending between the container's contoured sides.

15 Claims, 6 Drawing Sheets

(56) References Cited

U.S. PATENT DOCUMENTS

D188,628 S * 8/1960 Heintze ..... D9/542
D189,696 S * 1/1961 Nagel ..... D7/619.1
D190,399 S * 5/1961 Agin ..... D9/558
D191,069 S * 8/1961 Schacher et al ..... D9/543
D195,368 S * 6/1963 Koenigsberg ..... D9/542
D195,600 S * 7/1963 Neyman ..... D9/523
D199,203 S * 9/1964 Dailey ..... D9/561
3,152,710 A * 10/1964 Platte ..... 215/384
D201,998 S * 8/1965 Kirsby ..... D9/522
D206,495 S * 12/1966 Utley ..... D9/542
D207,429 S * 4/1967 McLean ..... D9/522
D207,800 S * 5/1967 Roberts ..... D9/565
D211,316 S * 6/1968 Kustermann ..... D9/543
D211,933 S * 8/1968 Horne ..... D9/522
D215,699 S * 10/1969 Horne et al. ..... D9/542
D215,700 S * 10/1969 Thomson ..... D9/542
D217,227 S * 4/1970 Christiansen ..... D9/543
D221,133 S * 7/1971 Wikke ..... D9/529
D221,794 S * 9/1971 Appel et al. ..... D7/597
D223,142 S * 3/1972 Koenigsberg ..... D9/529
D226,178 S * 1/1973 Bystedt et al. ..... D9/773
D229,723 S * 12/1973 Grimes ..... D24/197
D233,737 S * 11/1974 Beaver ..... D9/531
D234,249 S * 2/1975 Holzaepfel ..... D9/529
D235,311 S * 6/1975 Cramer ..... D9/529
D236,432 S * 8/1975 McKibben O'Brien ..... D9/542
D245,314 S * 8/1977 Mitchell ..... D9/538
D245,758 S * 9/1977 Pardo ..... D9/529
D251,111 S * 2/1979 Furlong et al. ..... D9/549
D254,838 S * 4/1980 Agnone et al. ..... D9/691
D255,986 S * 7/1980 Chang et al. ..... D9/526
D271,468 S * 11/1983 Soos ..... D9/529
D271,856 S * 12/1983 Suhajda et al. ..... D9/523
D274,604 S * 7/1984 Jeruchim ..... D9/526
D277,734 S * 2/1985 Harris ..... D9/545
D277,823 S * 3/1985 Harris ..... D9/690
D278,119 S * 3/1985 Harris ..... D9/690
D278,122 S * 3/1985 Harris ..... D9/545
D278,123 S * 3/1985 Harris ..... D9/545
D278,973 S * 5/1985 Harris ..... D9/690
4,572,384 A * 2/1986 Vesborg ..... 215/385
D284,743 S * 7/1986 Poore et al. ..... D9/531
D294,115 S * 2/1988 Jacobs et al. ..... D9/500
D304,550 S * 11/1989 Demarest ..... D9/529
4,885,809 A * 12/1989 Muchmore ..... 4/259
D305,731 S * 1/1990 Jacobs et al. ..... D9/531
D308,330 S * 6/1990 Teece ..... D9/725
D308,824 S * 6/1990 Wiseman et al. ..... D9/521
D310,779 S * 9/1990 Gloeckler ..... D9/529
D313,178 S * 12/1990 Guislain ..... D9/523
D314,703 S * 2/1991 Segati ..... D9/523
5,052,567 A * 10/1991 Colani ..... 215/384
D323,456 S * 1/1992 Gonda ..... D9/527
D324,331 S * 3/1992 Schmidt ..... D9/516
D324,334 S * 3/1992 Thomas et al. ..... D9/531
D327,640 S * 7/1992 Sherman et al. ..... D9/543
D328,712 S * 8/1992 Butler et al. ..... D9/526
D330,515 S * 10/1992 Patel et al. ..... D9/523
5,156,285 A * 10/1992 Zogg et al. ..... 215/384
D333,266 S * 2/1993 Walravens ..... D9/520
D334,713 S * 4/1993 Segati ..... D9/543
D340,217 S * 10/1993 Delage et al. ..... D12/411
D343,361 S * 1/1994 More ..... D9/529
D343,794 S * 2/1994 D'Amico et al. ..... D9/530
D344,896 S * 3/1994 Zogg et al. ..... D9/543
D346,112 S * 4/1994 Alcindor ..... D9/726
D347,389 S * 5/1994 Crawford ..... D9/529
D347,790 S * 6/1994 Lathrop et al. ..... D9/523
D347,791 S * 6/1994 Lathrop et al. ..... D9/523
5,330,054 A * 7/1994 Brown ..... 206/459.5
D354,000 S * 1/1995 Hoyt ..... D9/543
D356,505 S * 3/1995 Gonda et al. ..... D9/543
D356,506 S * 3/1995 Kornick et al. ..... D9/645
D357,187 S * 4/1995 Sherman ..... D9/540
D376,310 S * 12/1996 Crawford ..... D9/682
D376,430 S * 12/1996 Humphrey et al. ..... D24/197
D378,573 S * 3/1997 Sherman ..... D9/526
D382,208 S * 8/1997 Goettner et al. ..... D9/543
D382,803 S * 8/1997 Gavin ..... D9/526
D387,278 S * 12/1997 Olivares et al. ..... D9/541
D387,280 S * 12/1997 Zimmer et al. ..... D9/543
D389,065 S * 1/1998 Goettner ..... D9/526
D392,390 S * 3/1998 Chan et al. ..... D24/197
D394,812 S * 6/1998 Crawford ..... D9/543
D395,604 S * 6/1998 Lecoule ..... D9/522
D396,412 S * 7/1998 Murphy ..... D9/520
D398,244 S * 9/1998 Bertolini et al. ..... D9/565
D399,005 S * 9/1998 Chan et al. ..... D24/197
D399,431 S * 10/1998 de Baschmakoff ..... D9/540
D399,747 S * 10/1998 Bertolini et al. ..... D9/520
D400,091 S * 10/1998 Croft et al. ..... D9/693
D400,800 S * 11/1998 Bertolini et al. ..... D9/565
D401,857 S * 12/1998 Collins et al. ..... D9/526
D404,293 S * 1/1999 Bertolini et al. ..... D9/693
D407,316 S * 3/1999 Zaksenberg ..... D9/523
D409,093 S * 5/1999 Goettner ..... D9/543
D412,282 S * 7/1999 Cacciato ..... D9/530
D413,805 S * 9/1999 Phillips ..... D9/526
D420,291 S * 2/2000 Gnann et al. ..... D9/554
D420,448 S * 2/2000 Brown et al. ..... D24/197
D423,942 S * 5/2000 Markey et al. ..... D9/552
6,073,788 A * 6/2000 Stroud ..... 215/11.1
D429,165 S * 8/2000 Zogg et al. ..... D9/543
D429,649 S * 8/2000 Kotyuk ..... D9/552
6,095,705 A * 8/2000 Phillips ..... 401/6
D430,801 S * 9/2000 Harrity et al. ..... D9/520
D431,191 S * 9/2000 Farris ..... D9/529
D435,098 S * 12/2000 Kemmis et al. ..... D23/366
D437,548 S * 2/2001 Desgrippes et al. ..... D9/688
D438,786 S * 3/2001 Ghali ..... D9/685
D438,801 S * 3/2001 Mohary et al. ..... D9/520
D440,876 S * 4/2001 Togasawa ..... D9/529
D441,293 S * 5/2001 Togasawa ..... D9/529
D443,824 S * 6/2001 Farris ..... D9/529
D443,825 S * 6/2001 Goettner ..... D9/530
6,247,606 B1 * 6/2001 Zogg ..... 215/385
D445,691 S * 7/2001 Farris ..... D9/530
D445,692 S * 7/2001 Meeker et al. ..... D9/530
D446,725 S * 8/2001 Lloyd ..... D9/521
D448,301 S * 9/2001 Togasawa ..... D9/521
D448,998 S * 10/2001 Farris ..... D9/522
D449,229 S * 10/2001 Mohary et al. ..... D9/558
D449,534 S * 10/2001 LeCoule ..... D9/522
D452,156 S * 12/2001 Kokenge et al. ..... D9/521
D453,112 S * 1/2002 Macky et al. ..... D9/538
D454,072 S * 3/2002 Harrity et al. ..... D9/531
D455,655 S * 4/2002 Bunce ..... D9/521
D455,966 S * 4/2002 Patterson ..... D9/560
D458,141 S * 6/2002 Crawford et al. ..... D9/530
D458,142 S * 6/2002 Schuller et al. ..... D9/530
D458,542 S * 6/2002 Cummings et al. ..... D9/530
D459,231 S * 6/2002 Crawford et al. ..... D9/530
D459,232 S * 6/2002 Crawford et al. ..... D9/530
D460,917 S * 7/2002 Trabal ..... D9/551
D462,273 S * 9/2002 Crawford ..... D9/542
D462,619 S * 9/2002 Crawford ..... D9/542
D462,896 S * 9/2002 Crawford et al. ..... D9/693
D463,981 S * 10/2002 Crawford et al. ..... D9/530
D466,020 S * 11/2002 Crawford et al. ..... D9/530
D468,643 S * 1/2003 Kuzma et al. ..... D9/552
D471,459 S * 3/2003 Denham et al. ..... D9/524
D471,461 S * 3/2003 McGowan ..... D9/522
D477,066 S * 7/2003 Lonczak et al. ..... D9/658
D481,636 S * 11/2003 Camacho ..... D9/522
D482,976 S * 12/2003 Melrose ..... D9/537
D484,805 S * 1/2004 Colangelo et al. ..... D9/523
D492,588 S * 7/2004 Herrmann ..... D7/682
D496,733 S * 9/2004 Morano et al. ..... D24/197
D496,863 S * 10/2004 Aldrey et al. ..... D9/523
D497,312 S * 10/2004 Anderson et al. ..... D9/522
D499,490 S * 12/2004 Conaway ..... D24/197
D499,967 S * 12/2004 Carlson et al. ..... D9/552
D502,404 S * 3/2005 Hunt et al. ..... D9/543
D507,490 S * 7/2005 Mero et al. ..... D9/550

(56) References Cited

U.S. PATENT DOCUMENTS

| | | | | | |
|---|---|---|---|---|---|
| D507,748 | S | * | 7/2005 | McCutchan et al. | D9/521 |
| D508,414 | S | * | 8/2005 | Lamb et al. | D9/522 |
| D509,142 | S | * | 9/2005 | Blasko et al. | D9/521 |
| D509,743 | S | * | 9/2005 | Blasko et al. | D9/521 |
| D509,745 | S | * | 9/2005 | Hill et al. | D9/529 |
| D509,747 | S | * | 9/2005 | Carlson et al. | D9/552 |
| D511,299 | S | * | 11/2005 | Angeletta | D9/540 |
| D511,836 | S | * | 11/2005 | Morano et al. | D24/197 |
| D512,916 | S | * | 12/2005 | Floyd et al. | D9/516 |
| D515,427 | S | * | 2/2006 | Schuller et al. | D9/516 |
| D516,432 | S | * | 3/2006 | McCutchan et al. | D9/521 |
| D524,657 | S | * | 7/2006 | Harris et al. | D9/522 |
| D526,204 | S | * | 8/2006 | Stolle | D9/529 |
| D526,903 | S | * | 8/2006 | Duranthon | D9/565 |
| D527,638 | S | * | 9/2006 | Stolle | D9/522 |
| D533,066 | S | * | 12/2006 | Mongeon et al. | D9/522 |
| D533,785 | S | * | 12/2006 | Corbett et al. | D9/538 |
| D535,884 | S | * | 1/2007 | Davis et al. | D9/538 |
| D536,255 | S | * | 2/2007 | Corbett et al. | D9/538 |
| D537,365 | S | * | 2/2007 | Giggs et al. | D9/734 |
| D538,168 | S | * | 3/2007 | Davis et al. | D9/538 |
| 7,191,910 | B2 | * | 3/2007 | Deemer et al. | 215/381 |
| D540,680 | S | * | 4/2007 | Perry et al. | D9/516 |
| D541,172 | S | * | 4/2007 | McConville et al. | D9/729 |
| D543,116 | S | * | 5/2007 | Heisner | D9/540 |
| D543,460 | S | * | 5/2007 | Perry et al. | D9/516 |
| D543,461 | S | * | 5/2007 | Mongeon et al. | D9/516 |
| D545,203 | S | * | 6/2007 | Perry et al. | D9/529 |
| D545,682 | S | * | 7/2007 | Mongeon et al. | D9/529 |
| D546,187 | S | * | 7/2007 | Ratzlaff | D9/529 |
| D547,187 | S | * | 7/2007 | Floyd et al. | D9/516 |
| D547,198 | S | * | 7/2007 | Eaton et al. | D9/658 |
| D547,664 | S | * | 7/2007 | Davis et al. | D9/538 |
| D549,588 | S | * | 8/2007 | Isono | D9/565 |
| D552,479 | S | * | 10/2007 | Mongeon et al. | D9/565 |
| D553,994 | S | * | 10/2007 | Macak et al. | D9/564 |
| D554,514 | S | * | 11/2007 | Floyd et al. | D9/530 |
| D554,997 | S | * | 11/2007 | Perry et al. | D9/516 |
| D554,998 | S | * | 11/2007 | Perry et al. | D9/516 |
| D555,000 | S | * | 11/2007 | Bunce et al. | D9/529 |
| D555,001 | S | * | 11/2007 | Perry et al. | D9/529 |
| D555,003 | S | * | 11/2007 | Perry et al. | D9/552 |
| D556,049 | S | * | 11/2007 | Mongeon et al. | D9/565 |
| D556,586 | S | * | 12/2007 | Mongeon et al. | D9/529 |
| D556,598 | S | * | 12/2007 | Culeron et al. | D9/565 |
| D557,134 | S | * | 12/2007 | Wolpert et al. | D9/414 |
| D558,053 | S | * | 12/2007 | Lake et al. | D9/541 |
| D558,578 | S | * | 1/2008 | Mongeon et al. | D9/529 |
| D558,580 | S | * | 1/2008 | Kuzma et al. | D9/541 |
| D559,112 | S | * | 1/2008 | Hyde et al. | D9/538 |
| D561,037 | S | * | 2/2008 | Boon | D9/539 |
| D561,596 | S | * | 2/2008 | Hyde et al. | D9/538 |
| D563,225 | S | * | 3/2008 | Mongeon et al. | D9/516 |
| D564,706 | S | * | 3/2008 | Kadlubowski et al. | D28/76 |
| D564,889 | S | * | 3/2008 | Boon | D9/539 |
| D565,416 | S | * | 4/2008 | Lepoitevin | D9/538 |
| D565,955 | S | * | 4/2008 | Bernard et al. | D9/521 |
| D568,162 | S | * | 5/2008 | Mongeon et al. | D9/529 |
| D572,599 | S | * | 7/2008 | Melrose | D9/652 |
| D573,890 | S | * | 7/2008 | Mongeon et al. | D9/529 |
| D576,041 | S | * | 9/2008 | Melrose et al. | D9/516 |
| D578,397 | S | * | 10/2008 | Caldwell | D9/523 |
| D578,892 | S | * | 10/2008 | Bridgman et al. | D9/522 |
| D579,342 | S | * | 10/2008 | Claughton et al. | D9/688 |
| D579,780 | S | * | 11/2008 | Lepoitevin | D9/541 |
| D581,284 | S | * | 11/2008 | Mayers | D9/543 |
| D581,285 | S | * | 11/2008 | Lepoitevin | D9/550 |
| D583,243 | S | * | 12/2008 | Botti et al. | D9/530 |
| D583,245 | S | * | 12/2008 | Lepoitevin | D9/538 |
| D583,673 | S | * | 12/2008 | Freeborn et al. | D9/542 |
| D585,282 | S | * | 1/2009 | Haubert et al. | D9/521 |
| D585,283 | S | * | 1/2009 | Bridgman et al. | D9/522 |
| D585,284 | S | * | 1/2009 | Bridgman et al. | D9/522 |
| D585,295 | S | * | 1/2009 | Mayers et al. | D9/563 |
| D586,219 | S | * | 2/2009 | Bridgman et al. | D9/522 |
| D586,220 | S | * | 2/2009 | Bridgman et al. | D9/522 |
| D586,655 | S | * | 2/2009 | Bridgman et al. | D9/522 |
| D588,924 | S | * | 3/2009 | Hainaut et al. | D9/552 |
| D589,810 | S | * | 4/2009 | van der Krogt et al. | D9/529 |
| D593,862 | S | * | 6/2009 | Ribadeneira Mejia et al. | D9/516 |
| D594,340 | S | * | 6/2009 | Eilken et al. | D9/529 |
| 7,581,654 | B2 | * | 9/2009 | Stowitts | 215/383 |
| 2003/0015491 | A1 | * | 1/2003 | Melrose et al. | 215/381 |
| 2004/0164048 | A1 | * | 8/2004 | Yourist | 215/398 |
| 2005/0121408 | A1 | * | 6/2005 | Deemer et al. | 215/381 |
| 2005/0184027 | A1 | * | 8/2005 | Floyd et al. | 215/384 |
| 2005/0252880 | A1 | * | 11/2005 | Pedmo et al. | 215/381 |
| 2007/0007236 | A1 | * | 1/2007 | Casscles et al. | 215/396 |
| 2007/0045223 | A1 | * | 3/2007 | Noll et al. | 215/384 |
| 2007/0075032 | A1 | * | 4/2007 | Kelley et al. | 215/384 |
| 2007/0090083 | A1 | * | 4/2007 | Trude | 215/384 |
| 2008/0041812 | A1 | * | 2/2008 | Stowitts | 215/384 |
| 2008/0257856 | A1 | * | 10/2008 | Melrose et al. | 215/381 |

* cited by examiner

ERGONOMIC DISPENSING CONTAINER

CROSS-REFERENCE TO RELATED APPLICATION

The present application is a continuation-in-part of United States design patent application 29/275,159, filed Dec. 15, 2006, which issued as U.S. Pat. No. D588,924 S on Mar. 24, 2009.

FIELD OF THE INVENTION

The present invention relates to a container for dispensing a material. More particularly, the present invention relates to a container shaped and configured to facilitate orienting the container in a desired position, such as for dispensing material.

BACKGROUND OF THE INVENTION

Containers with contoured walls that facilitate gripping of the container are well-known in the art and have become increasingly popular. One common type of container with a contoured wall is a container with a diameter too large to be gripped readily with one hand. Shaping the container to have an integrally formed contoured grip facilitates gripping of the container with a single hand to dispense the contents of the container. An example of such a container is a juice bottle with an integrally formed grip section in the side wall of the container.

Hand-held containers with diameters small enough to permit the container to be readily grasped and held in a single hand have also been formed with contours to further facilitate gripping of the container. In contrast with larger-diameter containers having a gripping section along only one side thereof, such hand-held containers typically are contoured about their entire circumference. In other words, the contouring extends completely around the container, such that the container is essentially symmetrical about its central axis.

SUMMARY OF THE INVENTION

The present invention relates to a container with surfaces that not only facilitate grasping thereof but also facilitate orienting the container in a desired position for dispensing the product contained therein. In particular, a container formed in accordance with the principles of the present invention has contours that result in essentially automatic orientation of the container upon grasping the contoured areas on the container. Visual assessment of the container to orient the container in a particular position thus is not required.

The container may be shaped and dimensioned to be grasped and held in a single hand. Contours formed in accordance with the principles of the present invention may be readily felt upon grasping the container in the user's palm, and the user may readily reorient the container by rotating the container in his/her palm.

Such automatic ready orientation of a container upon simply grasping the container is particularly beneficial with containers having a dispensing orifice offset from a central axis of the container such that proper orientation of the container is important for use thereof. However, orientation of the container in a particular direction may be desirable for other purposes instead.

An additional optional feature of a container formed in accordance with the principles of the present invention is the provision of a dispensing end that is asymmetrical about at least one axis to further facilitate orienting of the container in a particular desired direction. Such configuration of the dispensing end permits the user to distinguish the orientation of the container with reference to the dispensing end as well, and thus further contributes to the ability of the shape of the container to guide orientation of the container upon grasping.

It will be appreciated that the contouring of the container body and dispensing end formed in accordance with the principles of the present invention, either individually or in combination, permit orientation of the container without visual assessment of the container. Thus, the container may readily be oriented by a visually impaired user or in low lighting situations that impair visual assessment of the container.

These and other features and advantages of the present invention will be readily apparent from the following detailed description of the invention, the scope of the invention being set out in the appended claims.

BRIEF DESCRIPTION OF THE DRAWINGS

The detailed description will be better understood in conjunction with the accompanying drawings, wherein like reference characters represent like elements, as follows.

DETAILED DESCRIPTION OF THE INVENTION

Figure 1:
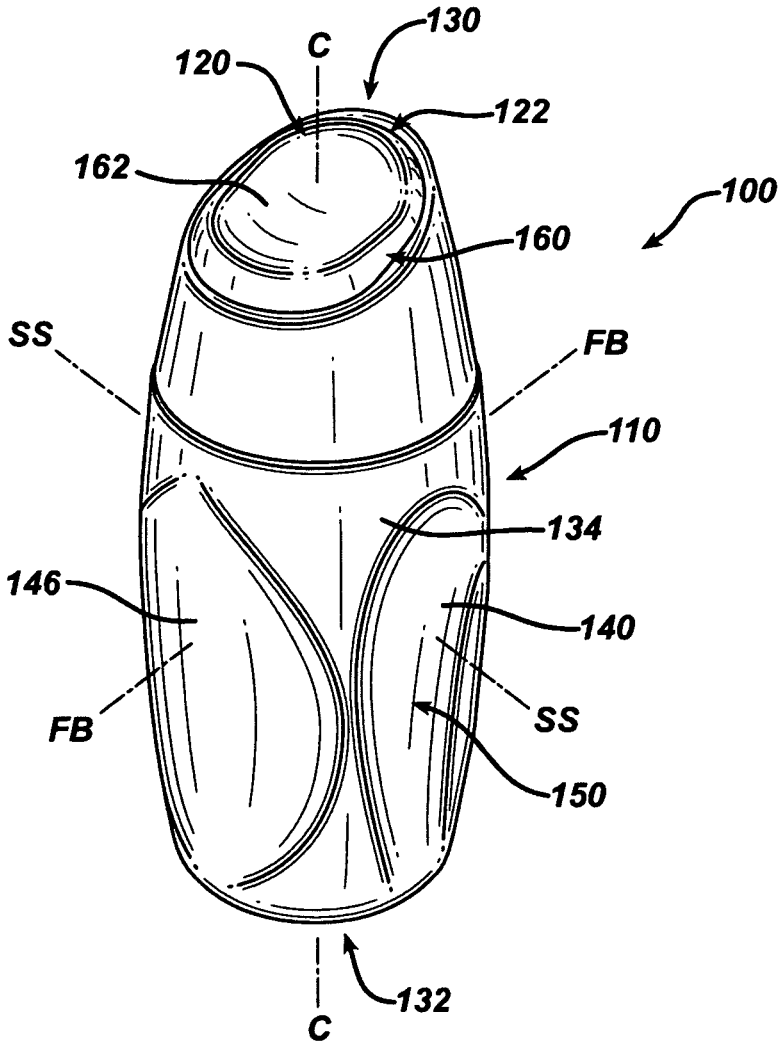
FIG. 1 is a perspective view of a container formed in accordance with the principles of the present invention.
Figure 2:
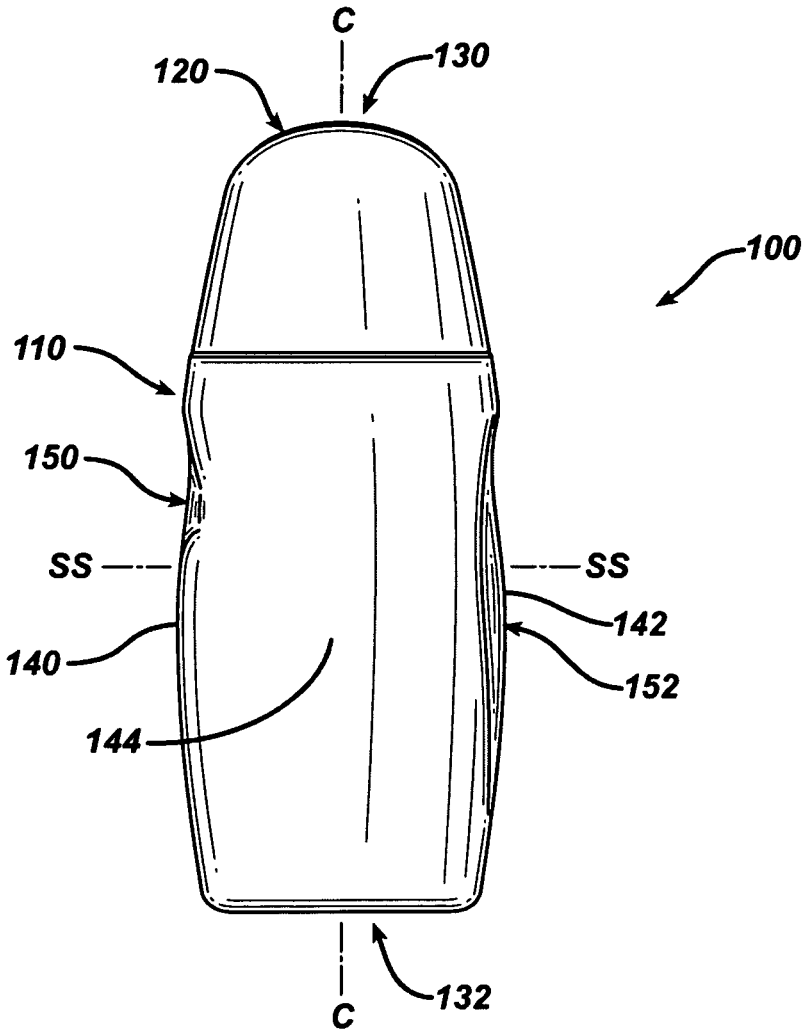
FIG. 2 is a front elevational view of the container of FIG. 1.
Figure 3:
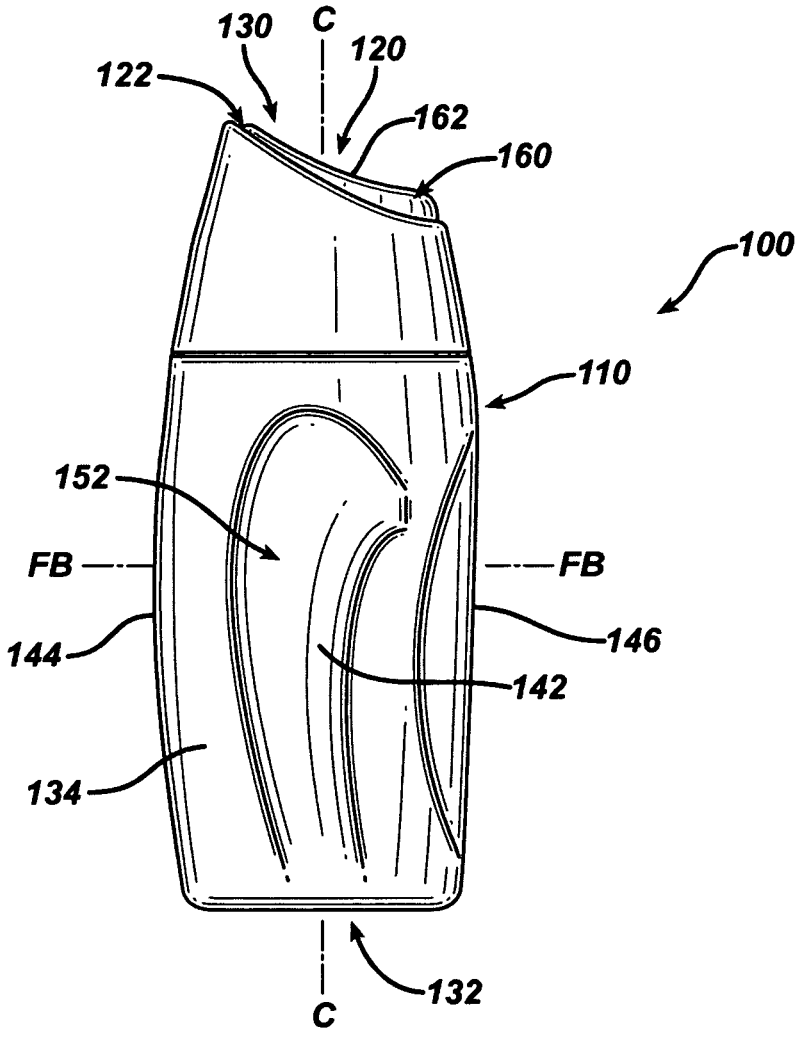
FIG. 3 is a right side elevational view of the container of FIG. 1.
Figure 4:
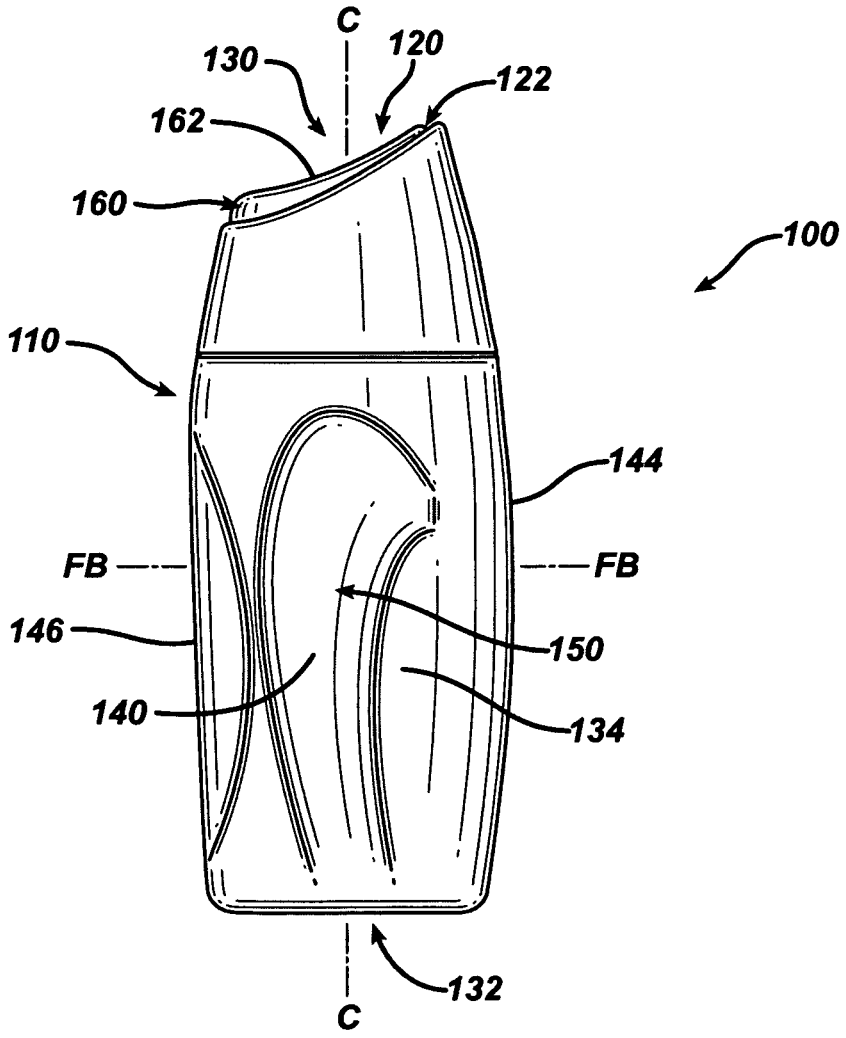
FIG. 4 is a left side elevational view of the container of FIG. 1.
Figure 5:
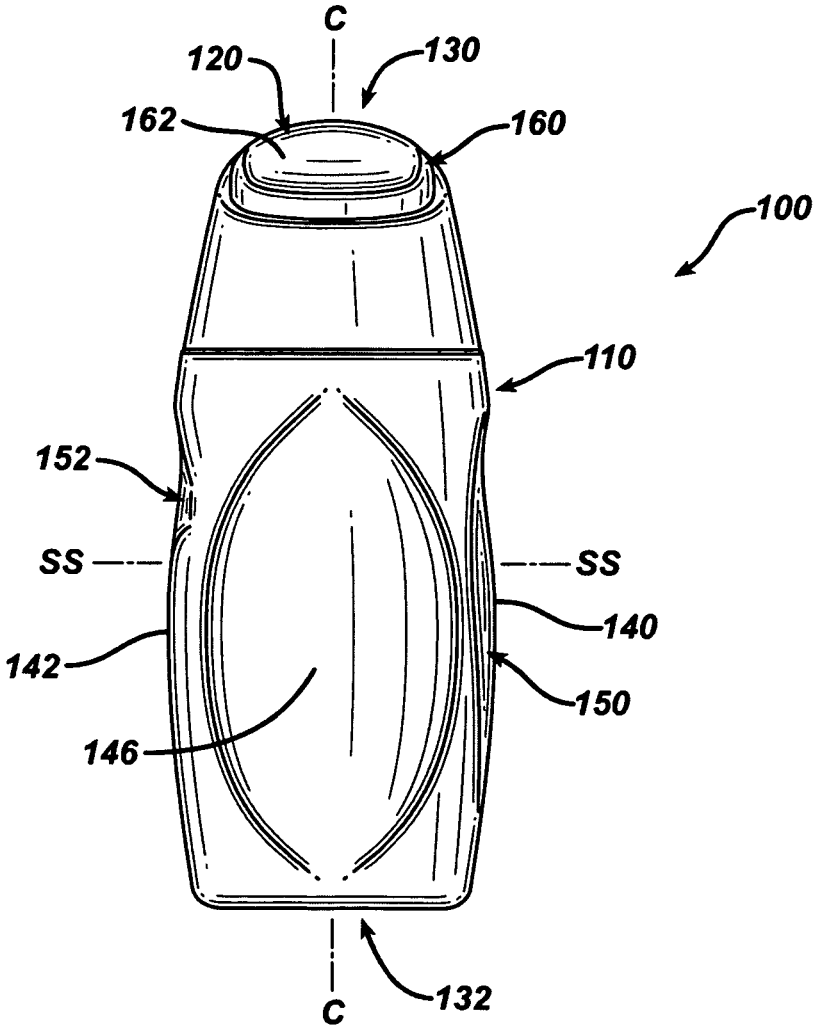
FIG. 5 is a back elevational view of the container of FIG. 1.

An exemplary container 100 formed in accordance with the principles of the present invention is illustrated in FIG. 1-5. It will be appreciated that although container 100 has a main body portion 110 and a separate dispensing portion 120 (in the form of a closure), the principles of the present invention may be applied to containers having monolithic main body and dispensing portions. Dispensing portion 120 of exemplary container 100 has a dispensing end 122 at which a dispensing orifice is provided for dispensing material stored or held within container 100 (such as in a reservoir in main body portion 110). The location, shape, and configuration of the dispensing orifice may be selected based on any of a variety of factors, such as the material to be dispensed, the speed at which material is desired to be dispensed, etc., as may be appreciated by one of ordinary skill in the art. It therefore will be understood that the present invention is not necessarily limited by the shape, configuration, or type of dispensing orifice. Container 100 has a central axis C, a top end 130 at one end of central axis C and associated with dispensing portion 120, a bottom end 132 at an end of central axis C opposite top end 130, and a side surface 134 extending between top end 130 and bottom end 132 and around central axis C.

Grasping of container 100 in a particular orientation may be desirable for any number of reasons. In accordance with the principles of the present invention, side surface 134 of the exemplary embodiment of FIGS. 1-5 is contoured to facilitate orientation of container 100 in a user's hand. Because a specific orientation of container 100 is generally desired, it will be appreciated that contours formed in accordance with the principles of the present invention preferably are discontinuous to distinguish a left side 140 opposite a right side 142, and a front side 144 opposite a back side 146 (with front and back sides 144, 146 between left and right sides 140, 142). Exemplary contours 150, 152 are illustrated in the exemplary embodiment of FIGS. 1-5 as a depression in each of left and right sides 140, 142 in side surface 134. However, it will be appreciated that contours may be provided in front and back sides 144, 146 to distinguish those sides, instead. Preferably, contours 150, 152 are shaped or configured to guide or otherwise to draw the user to grasp container 100 at contours 150, 152.

Although contours 150, 152 may be said to differentiate otherwise indistinguishable sides of a container, it will be appreciated that a container formed in accordance with the principles of the present invention may alternatively have a side surface with sides that are clearly differentiated independent of contouring, such as a container with a square cross-section. The principles of the present invention may be applied to a container with distinct sides to further distinguish the sides into grasping sides such that upon grasping such sides, the container is automatically oriented in a desired direction. If desired, at least one of sides 140, 142, 144, 146 (whether or not readily differentiated from one another without the aide of contours 150, 152) may be formed as a label panel (e.g., contoured to readily receive a label, such as by virtue of not having compound curvatures).

The precise curvature of contours 150, 152 may be selected to comfortably fit a user's finger or fingers. Preferably, a concave curvature with smooth transitions to side surface 134 is provided. However, it will be appreciated that other curvatures are within the scope of the present invention. Moreover, it will be appreciated that contours 150, 152 may be in any other form that achieves the desired effect of a tactile guide to orient container 100 upon grasping container 100. For instance, contours 150, 152 may be in the form of raised areas (e.g., such as ribs or bumps or dots or any type of pattern extending from surface 134), or a textured area (e.g., an etched area increasing friction, a rubberized region, or any other change to the tactile qualities of side surface 134). If desired, though not essential to the present invention, the contours may be shaped so that a user may readily distinguish one from the other upon mere grasping of the contours without the need for visual inspection of the contours or the container.

Referring to the exemplary embodiment of FIGS. 1-5, container 100 may be said, for the sake of convenience, to have a front-back axis FB (extending between front side 144 and back side 146) and a side-side axis SS (extending between left side 140 and right side 142). Side surface 134 of container 100 is contoured on either side of front-back axis FB. Side-side axis SS of container 100 preferably passes through the contours. In the exemplary embodiment of FIGS. 1-5, side surface 134 is provided with left contour 150 along left side 140 and right contour 152 along right side 142. Upon placement of a thumb of a grasping hand on one of contours 150, 152 and at least one of the other four fingers of the grasping hand on the other of contours 150, 152, dispensing end 122 is automatically positioned in a convenient orientation for dispensing material from container 100. Preferably, the positioning of dispensing end 122 is essentially automatic upon grasping container 100 because the user essentially automatically is led to place the thumb of the grasping hand on one of contours 150, 152 and at least one of the other four fingers of the grasping hand on the other of contours 150, 152. In such position, container 100 is ready for dispensing material therefrom without the need to further reorient container 100.

One example of a situation in which grasping of container 100 in a particular orientation is desirable is to achieve dispensing of material therefrom in a desired direction. In accordance with one aspect of the present invention, as may be appreciated with reference to the exemplary embodiment of FIGS. 1, 3 and 4, dispensing end 122 may be offset from central axis C of container 100. Accordingly, it is desirable to grasp container 100 oriented with dispensing end 122 in a desired direction to achieve appropriate dispensing of material. As such, dispensing end 122 may be said to define front side 144 of container 100 in the general vicinity of dispensing end 122. Typically, when a user desires to dispense material from a container, the user positions the container with the dispensing orifice of the container in a particular orientation to permit the material to be dispensed in the desired direction. For instance, to dispense material from a hand-held container, the user generally grasps the container with a thumb of the grasping hand on one side of the container and at least one of the other four fingers of the grasping hand on the other side of the container such that the dispensing orifice is between those sides of the container and opposite the palm of the user's grasping hand. The thumb and the at least one other finger straddle the central axis of the container.

In accordance with the principles of the present invention, contours 150, 152 may facilitate orientation of container 100 in a user's hand such that upon grasping container 100, dispensing end 122 is automatically positioned for ready dispensation of material from container 100 in the desired direction. Specifically, side surface 134 is contoured to facilitate grasping of container 100 such that dispensing end 122 is positioned between the user's grasping thumb and the at least one other grasping finger, and opposite the palm of the grasping hand.

A container formed in accordance with the principles of the present invention, such as exemplary container 100 of FIGS. 1-5, may be provided with an additional feature associated with dispensing portion 120 to further provide directional guidance to orienting container 100 for dispensing material therefrom in a desired direction. For instance, as may be appreciated with reference to FIGS. 1-5, exemplary container 100 may have an asymmetrical dispensing portion 120 permitting ready distinguishing of the position of dispensing end 122 and the dispensing orifice therein. It is particularly convenient, though not essential to the present invention, to provide a dispensing portion 120 that is asymmetrical about side-side axis SS so that when container 100 is grasped in a user's hand, straddling central axis C, dispensing end 122 is either adjacent the palm of the grasping hand or opposite the palm of the grasping hand.

In the exemplary embodiment of FIGS. 1-5, dispensing portion 120 has a closure 160 with a slanted top surface 162, extending transverse to central axis C and substantially along side-side axis SS. Dispensing end 122 may be provided at the highest region, as illustrated. Thus, when a user grasps container 100 with a thumb of the grasping hand on one of contours 150, 152 and at least one of the other four fingers of the grasping hand on the other of contours 150, 152 the user may readily place an operating finger on closure 160 and know, with reference to the direction of the slant, that dispensing end 122 is facing away from the palm of the grasping hand and ready for dispensing material from container 100. Closure 160 may be any type of closure, such as a toggle-type closure with an actuator that is pressed downward at the end adjacent back side 146 of container 100 to pivot the actuator to expose a dispensing orifice adjacent front side 144 of container 100. However, other types of closures, such as slide closures or flip-top closures may be used. Preferably, closure 160 permits one-handed use to complement the intended easy one-handed use of container 100. Additionally, top surface 162 of closure 160 may have a concave contact surface for increased user comfort and to further enhance automatic positioning of container 100 for ready dispensing.

Although exemplary container 100 preferably is a hand-held container (i.e., a container that readily fits in a user's hand and may be grasped and held readily by one hand), it will be appreciated that the principles of the present invention may be applied to larger containers of which only a portion may be grasped and held in a user's hand. In the preferred hand-held embodiment, a further feature that may be provided to facilitate grasping is the contouring of side surface 134 to enhance grasping comfort when container 100 is held in the palm of a user's hand. In particular, as may be appreciated with reference to FIGS. 1-5, side surface 134 may be substantially convex so that the central portion midway between top end 130 and bottom end 132 is the widest portion and has a gradual convex curvature to fit comfortably in the palm of a user's hand.

Figure 6:
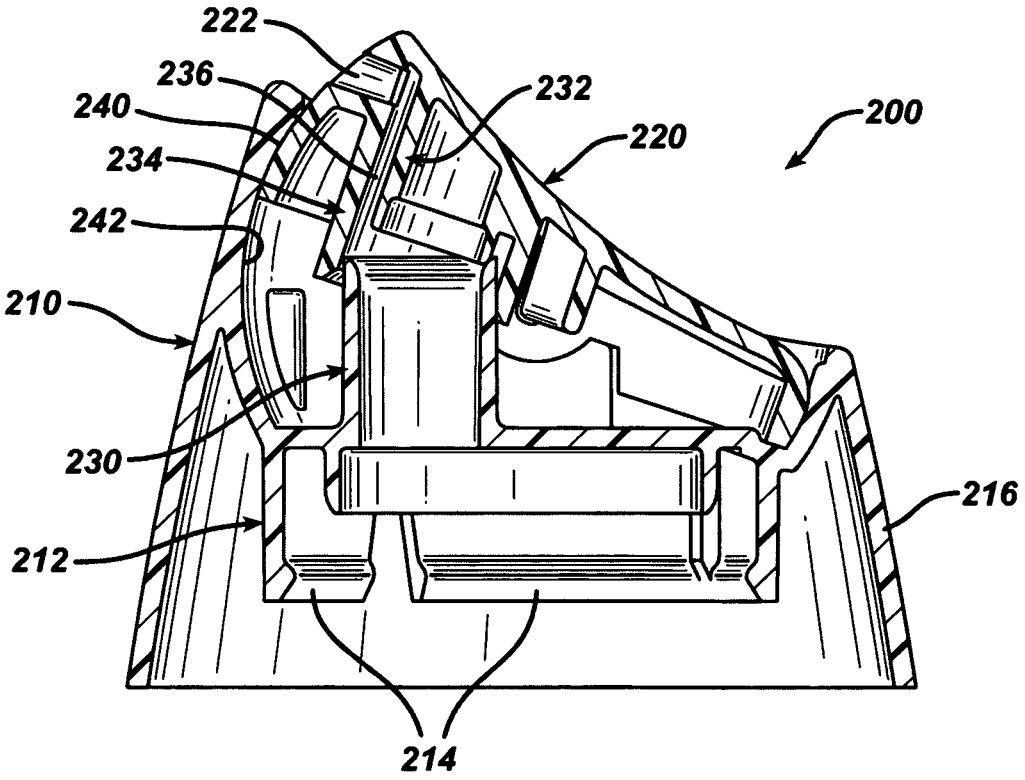
FIG. 6 is a cross-sectional view of a container closure formed in accordance with principles of the present invention.

In accordance with a separate and independent aspect of the present invention, a closure may be designed to address specific issues relating to the material contained within body portion 110 of container 100. An exemplary closure 200 is illustrated in FIG. 6 to address the specific challenges presented by the pouring dynamics of a viscous yet slippery material with low surface tension, such as silicone. It will be appreciated that the features of the closure 200 may be applied to closures for containers holding other types of fluids as well.

Because silicone is known to flow readily through miniscule cracks, tight fits of all parts of closure 200 are desirable to reduce, if not eliminate, leakage and/or seepage. There are several critical places at which fluid flow must be blocked or sealed in or out (depending on the point of reference on closure 200).

First, the coupling of closure 200 to the body of the container on which closure 200 is to be provided should have as close a fit as possible to minimize if not eliminate leakage. As illustrated in FIG. 6, closure body 210 has an inner skirt 212 with an inwardly directed bead or ramp 214 that may form an interference fit with the neck of the container on which closure 200 is to be provided. Preferably, the neck has a corresponding outwardly directed bead or ridge that interacts with ramp 214.

The second critical location for blocking undesired or inadvertent fluid flow is at the flow path from the fluid reservoir in the container through closure 200, closure actuator 220, and dispensing orifice 222 in actuator 220. In the embodiment illustrated in FIG. 6, a stovepipe-type connection is provided between closure body 210 and actuator 220, with a stationary stovepipe 230 fitting between inner and outer actuator stovepipes 232, 234. In the dispensing position illustrated in FIG. 6, fluid may flow from a container reservoir through stationary stovepipe 230 into flow passage 236 between inner and outer actuator stovepipes 232, 234, and out through dispensing orifice 222. In the closed position, stationary stovepipe 230 blocks flow of fluid from within stationary stovepipe 230 into flow passage 236 and thus blocks fluid from flowing though and out of dispensing orifice 222. It will be appreciated that a close fit of stovepipes 230, 232, 234 is desirable to achieve adequate blockage of undesired or inadvertent fluid flow. In particular, it is desirable that fluid does not seep below actuator 220 and into closure body 210 without returning to the material reservoir in the container on which closure 200 is provided. Such close fit may be achieved by appropriate selection of materials and dimensions of the parts of closure 200, as will be appreciated by one of ordinary skill in the art.

A third feature that may be provided to block undesired or inadvertent fluid flow is the formation of closure body 210 and actuator 220 to result in a close fit between these parts of closure 200 so that fluid exiting dispensing orifice 222 does not seep between actuator 220 and outer wall 216 of closure body 210 and down into closure body 210 below actuator 220 without returning to the material reservoir in the container on which closure 200 is provided. In the embodiment illustrated in FIG. 6, actuator 220 is a toggle-type actuator, and has a ball-in-socket fit with outer wall 216 of closure 200. As such, outer side surface 240 of actuator 220 and inner surface 242 of outer wall 216 have matching curved surfaces that slide with respect to each other and are in as close contact with each other as possible to prevent fluid from seeping between closure body 210 and actuator 220. Such fit also facilitates and stabilizes movement of actuator 220 with respect to closure body 210.

Another feature of a closure formed in accordance with the principles of the present invention is the modification of the dispensing orifice to control performance of dispensation of the fluid. In particular, it is desirable that fluid is dispensed from a container cleanly without dribbling or otherwise trickling in an undesired direction. Toggle-type actuators as in the embodiment of FIG. 6 typically have a dispensing orifice with a square or rectangular cross-section. However, modification of the cross-sectional shape of the dispensing orifice may be desired to achieve a particular fluid flow. In accordance with the principles of the present invention, a toggle-type actuator is formed with a dispensing orifice having a circular cross-section. Such cross-section has been found to result in a narrower fluid flow, and directs the fluid flow better than dispensing orifices with the standard square or rectangular cross-section. A more precise fluid flow may thus be achieved.

In addition, provision of a channel around the exit opening of the dispensing orifice with a circular cross-section to create a lip further contributes to a more precise fluid flow. It has been determined that provision of such a lip as the last surface the fluid sees before leaving the container results in a precise, crisp drop-off point for the fluid, preventing dribble of product along the outer surface of the closure and the container. In particular, the circumferential wall forming the channel around the dispensing orifice preferably has as thin a wall as possible to provide less surface area for the product to cling to than would be provided if a substantially planar surface surrounds the exit opening of the dispensing orifice. Fluid thus readily drops off from the defined edge of the circumferential wall as a defined drop of liquid, rather than clinging, spreading, and dribbling along the outer surface of the closure to the outside of the container. It will be appreciated that this feature may be used in conjunction with the features of the embodiment of FIG. 6 to enhance further the prevention of unwanted seepage of fluid. However, such feature may be provided in other types of closures, the benefits being independent of the features of the closure of FIG. 6.

A container formed in accordance with the principles of the present invention material is particularly suitable for dispensing a material such as a fluid. However, it will be appreciated that a container formed in accordance with the principles of the present invention may dispense any of a variety of different material, the particular material not affecting the automatic orienting features of the inventive container.

It will further be appreciated that the directional references "top," "bottom," "front," and "rear" do not limit the respective sides or faces to such orientation, but merely serve to distinguish these sides or faces from one another.

Finally, it will be appreciated that the various independent inventive features described herein may be used in any combination or individually without detracting from the benefits of each feature.

While the foregoing description and drawings represent an exemplary embodiment of the present invention, it will be understood that various additions, modifications and substitutions may be made therein without departing from the spirit and scope of the present invention. In particular, it will be clear to those skilled in the art that the present invention may be embodied in other specific forms, structures, arrangements, proportions, and with other elements and components, without departing from the spirit or essential characteristics thereof. One skilled in the art will appreciate that the invention may be used with many modifications of structure, arrangement, proportions, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being indicated by the appended claims, and not limited to the foregoing description.

What is claimed is:

1. A palm-held container sized to fit in a user's hand, said container comprising:

a central axis;

a top dispensing end and a bottom end at opposite ends of said central axis;

a side surface extending between said top and bottom ends;

a front-back axis substantially perpendicular to said central axis and defining:

a front side of said side surface at a first end of said front-back axis, and a back side of said side surface at a second end of said front-back axis opposite said first end, said back side including a label panel having a substantially flat surface in a direction along said central axis; and a side-side axis substantially perpendicular to said central axis and to said front-back axis, said side-side axis defining:

a left side of said side surface at a first end of said side-side axis, and a right side of said side surface at a second end of said side-side axis opposite said first end;

a closure at said top dispensing end and having a dispensing orifice offset from said central axis and proximate said front side;

a left depression defined by a left upper contour and a left lower contour, said left upper and lower contours converging proximate said front side and said top dispensing end to form a discontinuous left perimeter at least partially surrounding said left depression;

a right depression defined by a right upper contour and a right lower contour, said right upper and lower contours converging proximate said back side and said top dispensing end to form a discontinuous right perimeter at least partially surrounding said right depression;

wherein said left and right depressions are spaced apart circumferentially by said front side and said back side; wherein said front side is continuously convexly curved and does not have contours; wherein said front side fits in a palm of the user's hand; wherein said left upper and lower contours are circumferentially spaced apart a distance to facilitate a thumb of the user's grasping hand to fit within said left depression; and, wherein said right upper and lower contours are circumferentially spaced apart a distance to facilitate at least one finger of the user's grasping hand to fit within said right depression.

2. The palm-held container of claim 1, wherein said left and right depressions are curved and sized to receive the thumb and the at least one finger of the user's grasping hand, respectively.

3. The palm-held container of claim 1, wherein said bottom end is closed.

4. The palm-held container of claim 1, wherein a first portion of the left side is indistinguishable from a second portion of the right side.

5. The palm-held container of claim 1, wherein at least a portion of said back side is continuously convexly curved about said central axis and about an axis perpendicular to said central axis.

6. The palm-held container of claim 1, wherein one of said front and back sides has a widest portion midway between said top end and said bottom end.

7. The palm-held container of claim 1, said closure further comprising a flared skirt and a top surface extending transverse to said central axis along said side-side axis to permit tactile identification of said dispensing end.

8. The palm-held container of claim 7, wherein said closure is a toggle-type closure with said dispensing orifice opposite said back side and proximate said front side.

9. A container comprising:

an open top end;

a closed bottom end opposite said open top end along a central axis;

a cylindrical sidewall extending along said central axis between said closed bottom end and said open top end to define an interior reservoir, said cylindrical sidewall having:

a front side;

a back side opposite said front side;

a left side having a discontinuous left contour defined by:

a first lower concave exterior boundary proximate said front side and facing said front side; and, a first upper concave interior boundary proximate said back side and facing said first lower concave exterior boundary; and, a right side having a discontinuous right contour defined by:

a second lower concave exterior boundary proximate said back side and facing said back side; and, a second upper concave interior boundary proximate said front side and facing said second lower concave exterior boundary;

wherein a first portion of said left side is indistinguishable from a second portion of said right side; and, a removable closure coupled to said open top end, said removable closure comprising:

an oblique top having an actuator with a dispensing orifice disposed proximate said front side opposite said back side, wherein said oblique top slopes downwardly to provide tactile identification of said dispensing orifice;

an annular edge;

a flared skirt extending between the oblique top and the annular edge.

10. The container of claim 9, wherein said discontinuous left and right contours are spaced apart.

11. The container of claim 9, wherein said discontinuous left and right contours provide a tactile indication of desired container orientation.

12. The container of claim 9, wherein said closure is a toggle-type closure.

13. The container of claim 9, said cylindrical sidewall further comprising a label panel formed along one of said front and back sides, said label panel having a substantially flat surface in a direction along said central axis.

14. The container of claim 9, wherein said left are right sides are differentiated by said left and right contours and are otherwise indistinguishable.

15. The container of claim 9, wherein said container is oriented in a user's grasping hand in a position to dispense material from said dispensing orifice opposite a palm of the user's grasping hand.

* * * * *